US009285777B2

(12) United States Patent
Decoux et al.

(10) Patent No.: US 9,285,777 B2
(45) Date of Patent: Mar. 15, 2016

(54) METHOD AND SYSTEM FOR AUTHENTICATING A TIMEPIECE

(71) Applicant: SICPA HOLDING SA, Prilly (CH)

(72) Inventors: Eric Decoux, Vevey (CH); Andrea Callegari, Chavannes-près-Renens (CH); Yves Berthier, Metabief (FR)

(73) Assignee: SICPA HOLDING SA, Prilly (CH)

( * ) Notice: Subject to any disclaimer, the term of this patent is extended or adjusted under 35 U.S.C. 154(b) by 325 days.

(21) Appl. No.: 13/940,830

(22) Filed: Jul. 12, 2013

(65) Prior Publication Data

US 2014/0013847 A1 Jan. 16, 2014

Related U.S. Application Data

(60) Provisional application No. 61/739,392, filed on Dec. 19, 2012.

(30) Foreign Application Priority Data

Jul. 13, 2012 (EP) ..... 12005180

(51) Int. Cl.
*G04D 7/00* (2006.01)
*G04D 7/12* (2006.01)

(52) U.S. Cl.
CPC ..... *G04D 7/001* (2013.01); *G04D 7/1228* (2013.01)

(58) Field of Classification Search
CPC ..... G04D 7/001; G04D 7/1228
USPC ..... 73/579
See application file for complete search history.

(56) References Cited

U.S. PATENT DOCUMENTS 2,782,627 A 2/1957 Hetzel
3,690,144 A 9/1972 Bonny
(Continued)

FOREIGN PATENT DOCUMENTS

CH 694 111 A5 7/2004
DE 103 38932 A1 3/2005
(Continued)

OTHER PUBLICATIONS

M. Disher, "An Overview of the COSC Certificate and Testing Procedures," pp. 1-4, dated Feb. 12, 2000.
(Continued)

*Primary Examiner* — J M Saint Surin
(74) *Attorney, Agent, or Firm* — Greenblum & Bernstein, P.L.C.

(57) ABSTRACT

Embodiments relate to method for authenticating timepiece comprising measuring acoustic vibrations emitted by timepiece to obtain electrical signal, which indicates variation of magnitude of measured acoustic vibrations as function of time. The method includes processing electrical signal to attenuate plurality of acoustic events in said electrical signal, performing transform of processed electrical signal into a frequency domain to obtain frequency-domain power spectrum indicating variation of power of processed electrical signal as a function of frequency, identifying at least one narrow peak in frequency-domain power spectrum corresponding to at least one resonance frequency of a part of timepiece resonating in a quiet zone. The method also includes extracting at least one resonance frequency corresponding to at least one narrow peak, comparing extracted at least one resonance frequency with at least one reference resonance frequency, and deriving information on an authenticity of said timepiece based on the comparing.

43 Claims, 10 Drawing Sheets

(56) References Cited

U.S. PATENT DOCUMENTS

| | | | | |
|---|---|---|---|---|
| 3,756,066 | A * | 9/1973 | Bolliger | G04D 7/1214 73/1.48 |
| 3,811,315 | A | 5/1974 | Kunitomi | |
| 3,817,083 | A | 6/1974 | Jucker | |
| 3,864,957 | A | 2/1975 | Fujita | |
| 3,892,124 | A | 7/1975 | Reese | |
| 3,946,592 | A | 3/1976 | Ichikawa | |
| 4,012,941 | A * | 3/1977 | Jucker | G04D 7/1207 702/56 |
| 4,024,750 | A | 5/1977 | Erickson | |
| 4,028,927 | A | 6/1977 | Kikuyama et al. | |
| 4,078,419 | A | 3/1978 | Busch et al. | |
| 4,078,420 | A | 3/1978 | Reese | |
| 4,083,222 | A | 4/1978 | Stawiski | |
| 4,224,820 | A | 9/1980 | Sitkewich | |
| 4,320,529 | A * | 3/1982 | Maeda | H03J 3/14 368/10 |
| 4,452,082 | A * | 6/1984 | Miwa | G01N 29/11 73/599 |
| 5,572,488 | A | 11/1996 | Yamada et al. | |
| 5,619,616 | A | 4/1997 | Brady et al. | |
| 7,057,430 | B2 * | 6/2006 | Ogiso | H03B 5/326 327/156 |
| 7,605,372 | B2 * | 10/2009 | Hachin | G07D 7/0026 250/361 R |
| 7,979,731 | B2 * | 7/2011 | Futa | H04L 63/08 713/168 |
| 2003/0112708 | A1 | 6/2003 | Fujisawa et al. | |
| 2004/0113819 | A1 | 6/2004 | Gauthey et al. | |
| 2006/0293606 | A1 | 12/2006 | Tomita | |
| 2009/0278670 | A1 | 11/2009 | Karapatis | |
| 2011/0110200 | A1 | 5/2011 | Goeller | |
| 2013/0170327 | A1 | 7/2013 | Peters et al. | |
| 2014/0013846 | A1 * | 1/2014 | Decoux | G04D 7/001 73/579 |
| 2014/0019089 | A1 | 1/2014 | Decoux et al. | |
| 2015/0013460 | A1 * | 1/2015 | Favre | G04D 7/001 73/579 |
| 2015/0053006 | A1 | 2/2015 | Decoux et al. | |
| 2015/0053007 | A1 * | 2/2015 | Decoux | G04D 7/1207 73/579 |

FOREIGN PATENT DOCUMENTS

| | | | | |
|---|---|---|---|---|
| EP | 0 072 350 | A1 | 2/1983 | |
| EP | 1 021 790 | A1 | 7/2000 | |
| FR | 2 957 689 | A1 | 9/2011 | |
| JP | 05264335 | * | 10/1993 | |
| JP | 2010259629 | * | 11/2010 | Y02E 60/521 |
| WO | WO99/19831 | A1 | 4/1999 | |
| WO | WO99/21061 | A1 | 4/1999 | |

OTHER PUBLICATIONS

Search Report and Written Opinion in related International Application No. PCT/EP2013/064865, dated Aug. 21, 2013.

* cited by examiner

METHOD AND SYSTEM FOR AUTHENTICATING A TIMEPIECE

CROSS REFERENCE TO RELATED APPLICATIONS

The present application claims priority to U.S. Provisional Application No. 61/739,392 filed on Dec. 19, 2012, and to European Patent Application No. 12005180.0 filed on Jul. 13, 2012, the disclosures of which are expressly incorporated by reference herein in their entireties.

FIELD OF THE INVENTION

The present invention relates to a method and system for authenticating a timepiece, in particular a watch.

BACKGROUND OF THE INVENTION

Counterfeit consumer goods, commonly called knock-offs, are counterfeit or imitation products offered for sale. The spread of counterfeit goods has become global in recent years and the range of goods subject to counterfeiting has increased significantly.

Expensive watches (and spare parts for watches) are vulnerable to counterfeiting, and have been counterfeited for decades. A counterfeit watch is an unauthorized copy of a part or all of an authentic watch. According to estimates by the Swiss Customs Service, there are some 30 to 40 million counterfeit watches put into circulation each year. It is a common cliché that visitors to New York City are approached on the street by vendors with a dozen such counterfeit watches inside theirs coats, offered at bargain prices. Extremely authentic looking, but very poor quality counterfeit watches with self-winding mechanisms and fully working movements can sell for as little as twenty dollars. The problem is becoming more and more serious, with the quality of the counterfeits constantly increasing. For example, some counterfeits' movements and materials are of remarkably passable quality and may look good to the untrained eye and work well for some years, a possible consequence of increasing competition within the counterfeiting community. Counterfeit watches cause an estimated $1 Billion loss per year to the watch industry.

Authentication solutions that have been used for protection of consumer goods from counterfeiting are often based on marking the item with a specific material, code, or marking, engraving, etc. However, these methods modify the nature and the appearance of the object, and this is often not acceptable in the watch (and other luxury items) industry, where the design of the object and its visual appearance is of paramount importance. Also, these methods require an active intervention at the time of manufacturing and, correspondingly an important change of the production process.

Counterfeiters often focus on the outer appearance of the watch and fit a cheap movement inside, because the potential buyer tends to focus more on the outward appearance of the piece, and because good movements are expensive. Even when a good quality movement is used, it is very difficult and expensive to make an exact copy, and thus, the counterfeiter will prefer to use a movement that is easier to obtain and/or easier to manufacture. It is therefore desirable, when assessing the authenticity of a timepiece, to have as much information as possible not only on its outer appearance but also on its inner content. It is furthermore desirable not to have to open the piece when checking authenticity, as the operation requires specialized equipment and procedures, which may impact the performance and/or integrity of the piece (e.g., water tightness), and which may invalidate the manufacturer's warranty.

It is, therefore, desirable to be able to authenticate a timepiece in a manner that is as non-invasive and as reliable as possible without having to open the timepiece.

SUMMARY OF EMBODIMENTS OF THE INVENTION

An aim of the invention is to provide a method for authenticating a timepiece that is non-invasive and reliable.

This aim is solved by the subject matter of the independent claims. Preferred embodiments are subject matter of the dependent claims.

One embodiment of the invention provides a method for authenticating a timepiece comprising the steps of measuring acoustic vibrations emitted by said timepiece to obtain an electrical signal, said electrical signal indicating a variation of a magnitude of said measured acoustic vibrations as a function of time, wherein said electrical signal comprises a plurality of acoustic events associated with mechanical shocks taking place within said timepiece, the acoustic events being separated from each other by a respective quiet zone, processing said electrical signal so as to attenuate said plurality of acoustic events in said electrical signal, performing a transform of said processed electrical signal into a frequency domain to obtain a frequency-domain power spectrum indicating a variation of a power of said processed electrical signal as a function of frequency, processing the frequency-domain power spectrum so as to reveal at least one narrow peak in the frequency-domain power spectrum corresponding to at least one resonance frequency of a mechanical part of said timepiece resonating in a quiet zone, extracting the at least one resonance frequency corresponding to said at least one narrow peak, comparing said extracted at least one resonance frequency with at least one reference resonance frequency, and deriving information on an authenticity of said timepiece based on the comparison result.

According to a further embodiment of the invention, the method further comprises extracting a width of said revealed at least one narrow peak.

According to a further embodiment of the invention, the method further comprises extracting a relative amplitude of said revealed at least one narrow peak.

According to an embodiment of the invention, said transform of said processed electrical signal into a frequency domain is a Fourier transform, preferably a Fast Fourier transform.

According to an embodiment of the invention, said processing said electrical signal so as to attenuate said plurality of events in said electrical signal comprises the steps of sampling said electrical signal, calculating an envelope of said sampled electrical signal by averaging an absolute value of a plurality of samples, and calculating a ratio of said sampled electrical signal divided by said calculated envelope of said sampled electrical signal.

According to an embodiment of the invention, said processing said frequency-domain power spectrum so as to reveal at least one narrow peak in said frequency-domain power spectrum comprises filtering said frequency-domain power spectrum so as to reduce a background part and keep sharp peaks within said frequency-domain power spectrum. This can be done, e.g., by performing a derivative of the spectrum with respect to frequency or by wavelet de-noising of the spectrum. According to an embodiment of the invention, said processing said frequency-domain power spectrum so as to reveal at least one narrow peak in said frequency-domain power spectrum comprises the steps of calculating, for each frequency of said frequency-domain power spectrum, a module of a complex number obtained in performing said transform of said processed electrical signal into a frequency domain, and multiplying said module of said complex number by an absolute value of a difference between said module of said complex number and a module of a complex number for an immediately preceding frequency and by an absolute value of a difference between said module of said complex number and a module of a complex number for an immediately following frequency.

According to an embodiment of the invention, said method further comprises repeating said calculating and multiplying steps a predetermined number of times, and calculating, for each frequency of said frequency-domain power spectrum, an average of results of said repeated calculating and multiplying steps.

According to an embodiment of the invention, a frequency analysis of the decay of acoustic events in the quiet zone between acoustic events is achieved. According to an embodiment of the invention, said method further comprises introducing a resonator into said timepiece, said resonator having predetermined resonance frequency characteristics, wherein said comparing step comprises comparing said extracted at least one resonance frequency with said predetermined resonance frequency characteristics to derive information on an authenticity of said timepiece.

According to an embodiment of the invention, at least one of a material, thickness and width of said resonator is selected so as to obtain said predetermined resonance frequency characteristics.

According to an embodiment of the invention, said method further comprises encoding said predetermined resonance frequency characteristics to create a unique identifier for said timepiece having said resonator introduced therein.

Another embodiment of the invention provides a timepiece comprising a resonator having predetermined resonance frequency characteristics being selected so as to be recognizable based on at least one narrow peak in a frequency-domain power spectrum upon carrying out the method for authenticating a timepiece according to an embodiment of the invention.

Another embodiment of the invention provides a computer readable medium for storing instructions, which, upon being executed by a processor of a computer device, cause the processor to execute the steps of measuring acoustic vibrations emitted by a timepiece to obtain an electrical signal, said electrical signal indicating a variation of a magnitude of said measured acoustic vibrations as a function of time, wherein said electrical signal comprises a plurality of acoustic events associated with mechanical shocks taking place in said timepiece, said acoustic events being separated from each other by a respective quiet zone, processing said electrical signal so as to attenuate said plurality of acoustic events in said electrical signal, performing a transform of said processed electrical signal into a frequency domain to obtain a frequency-domain power spectrum indicating a variation of a power of said processed electrical signal as a function of frequency, processing said frequency-domain power spectrum so as to reveal at least one narrow peak in said frequency-domain power spectrum corresponding to at least one resonance frequency of a mechanical part of said timepiece resonating in a quiet zone, extracting said at least one resonance frequency corresponding to said at least one narrow peak, comparing said extracted at least one resonance frequency with at least one reference resonance frequency, and deriving an information on an authenticity of said timepiece based on the comparison result.

In certain embodiments, the information regarding an authenticity of the timepiece comprises one of an indication of authenticity and an indication of a counterfeit.

In additional embodiments, the method further comprises recertifying the timepiece when timepiece maintenance is performed.

In further embodiments, a threshold for determining a positive authentication of a timepiece is configured in dependence upon an age of the timepiece.

In certain embodiments, the one or more components whose resonance frequencies are detected may be two or more components acting as a single resonator.

Additional aspects of the invention are directed to a system for authenticating a timepiece. The system comprises a measuring tool configured to measure acoustic vibrations emitted by said timepiece to obtain an electrical signal, said electrical signal indicating a variation of a magnitude of said measured acoustic vibrations as a function of time, wherein said electrical signal comprises a plurality of acoustic events associated with mechanical shocks taking place in said timepiece, said acoustic events being separated from each other by respective quiet zones. The system additionally comprises an attenuating tool configured to process said electrical signal to attenuate said plurality of acoustic events in said electrical signal, and a transform tool configured to perform a transform of said processed electrical signal into a frequency domain to obtain a frequency-domain power spectrum indicating a variation of a power of said processed electrical signal as a function of frequency using a processor of a computing device. The system additionally comprises a peak identification tool configured to process said frequency-domain power spectrum so as to reveal at least one narrow peak in said frequency-domain power spectrum corresponding to at least one resonance frequency of a part of said timepiece resonating in a quiet zone, an extraction tool configured to extract said at least one resonance frequency corresponding to said at least one narrow peak; and an identification tool configured to create an identification code based on said at least one resonance frequency.

In certain embodiments, the system also includes a comparison tool configured to compare said extracted at least one resonance frequency with at least one reference resonance frequency; and an authenticity determination tool configured to determine an authenticity of said timepiece based on a result of the comparison tool.

Additional aspects of the present invention are directed to a method for generating an identifier for a timepiece. The method comprises measuring acoustic vibrations emitted by said timepiece to obtain an electrical signal, said electrical signal indicating a variation of a magnitude of said measured acoustic vibrations as a function of time. The electrical signal comprises a plurality of acoustic events associated with mechanical shocks taking place in said timepiece, said acoustic events being separated from each other by respective quiet zones. The method further comprises processing said electrical signal so as to attenuate said plurality of acoustic events in said electrical signal, and performing a transform of said processed electrical signal into a frequency domain to obtain a frequency-domain power spectrum indicating a variation of a power of said processed electrical signal as a function of frequency using a processor of a computing device. The also method comprises processing said frequency-domain power spectrum so as to identify at least one narrow peak in said frequency-domain power spectrum corresponding to at least one resonance frequency of a part of said timepiece resonating in a quiet zone, extracting said at least one resonance frequency corresponding to said at least one narrow peak, and creating an identification code based on the at least one resonance frequency.

In embodiments, the method further comprises storing the identification code in a storage system.

Additional aspects of the present invention are directed to method for generating an identifier for a timepiece. The method comprises measuring acoustic vibrations emitted by said timepiece to obtain an electrical signal, identifying at least one narrow peak in a frequency-domain power spectrum corresponding to at least one resonance frequency of a part of said timepiece resonating using a processor of a computing device, extracting said at least one resonance frequency corresponding to said at least one narrow peak, and creating an identification code based on the at least one resonance frequency.

Additional aspects of the present invention are directed a method for authenticating an item. The method comprises measuring acoustic vibrations emitted by the item to obtain an electrical signal, identifying at least one resonance frequency using the electrical signal, and creating an identification code based on the at least one resonance frequency using a processor of a computing device.

In some embodiments, the method further comprises comparing the at least one resonance frequency with at least one reference resonance frequency, and determining an authenticity of the item based on the comparing.

In some embodiments, the method further comprises comparing the identification code with at least one reference identification code, and determining an authenticity of the item based on the comparing.

In embodiments, the item comprises a timepiece.

In additional embodiments, the timepiece comprises a watch.

In yet further embodiments, the electrical signal indicates a variation of a magnitude of the measured acoustic vibrations as a function of time, wherein said electrical signal comprises a plurality of acoustic events associated with mechanical shocks taking place in said timepiece, said acoustic events being separated from each other by respective quiet zones.

In additional embodiments, the method further comprises processing said electrical signal to attenuate said plurality of acoustic events in said electrical signal.

In additional embodiments, the method further the identifying at least one resonance frequency using the electrical signal comprises processing the frequency-domain power spectrum to identify at least one narrow peak in said frequency-domain power spectrum corresponding to the at least one resonance frequency of a part of said timepiece resonating in a quiet zone.

BRIEF DESCRIPTION OF THE FIGURES

For a more complete understanding of the invention, as well as other objects and further features thereof, reference may be had to the following detailed description of the invention in conjunction with the following exemplary and non-limiting drawings wherein.

Figure 1:
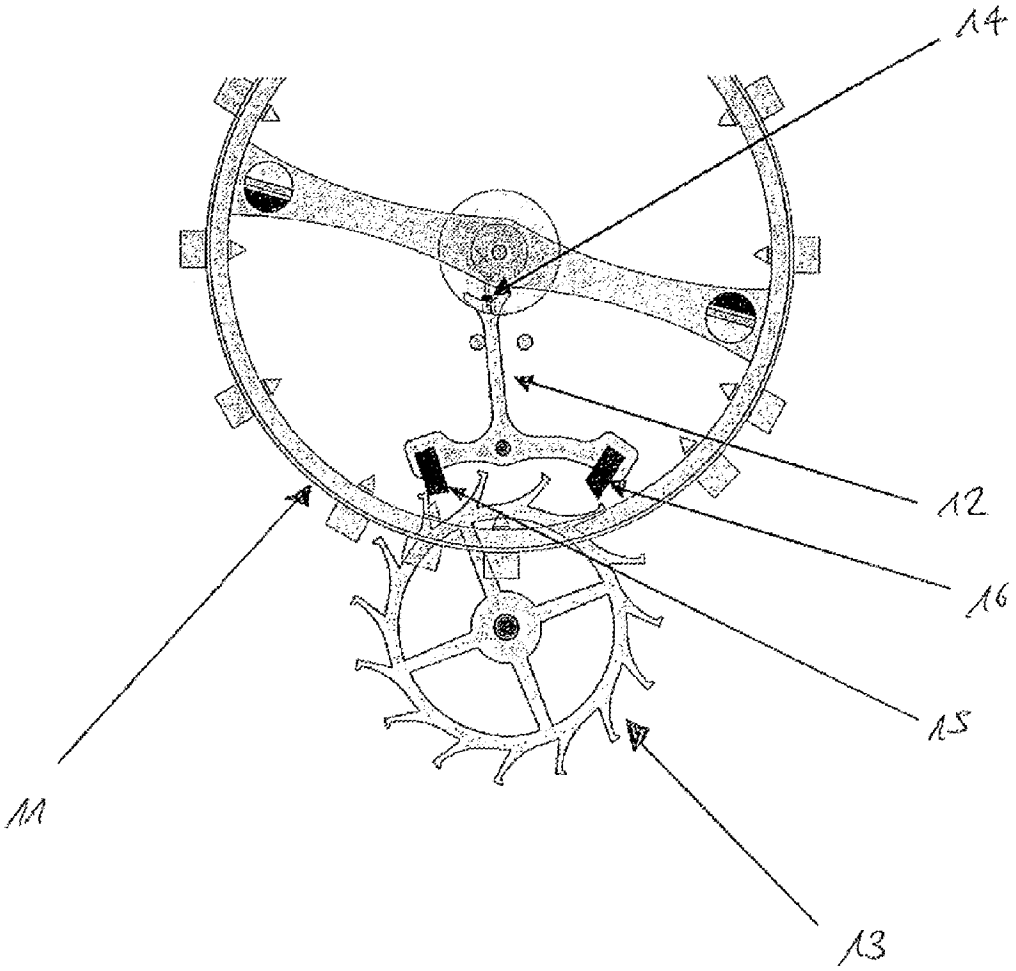
FIG. 1 is a schematic representation of an escapement in a timepiece.

Reference numbers refer to the same or equivalent parts of the present invention throughout the various figures of the drawings.

DETAILED DESCRIPTION OF EMBODIMENTS OF THE INVENTION

In the following description, the various embodiments of the present invention will be described with respect to the enclosed drawings.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention, including embodiments of flakes and films, may be embodied in practice.

Unless otherwise stated, a reference to a compound or component includes the compound or component by itself, as well as in combination with other compounds or components, such as mixtures of compounds.

As used herein, the singular forms "a," "an," and "the" include the plural reference unless the context clearly dictates otherwise. For example, reference to "a magnetic material" would also mean that mixtures of one or more magnetic materials can be present unless specifically excluded.

Except where otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not to be considered as an attempt to limit the application of the doctrine of equivalents to the scope of the claims, each numerical parameter should be construed in light of the number of significant digits and ordinary rounding conventions.

Additionally, the recitation of numerical ranges within this specification is considered to be a disclosure of all numerical values and ranges within that range. For example, if a range is from about 1 to about 50, it is deemed to include, for example, 1, 7, 34, 46.1, 23.7, or any other value or range within the range.

The various embodiments disclosed herein can be used separately and in various combinations unless specifically stated to the contrary.

A timepiece, such as a watch, comprises a mechanical movement which produces a characteristic noise, which is commonly referred to as tick-tock. This tick-tock sound, which is characteristic of a timepiece, is due to the impacts occurring between the various mechanical parts of the escapement of the timepiece, which is a device transferring energy to the time-keeping element, the so-called impulse action, and allowing the number of its oscillations to be counted, the locking action. The ticking sound is the sound of the gear train stopping at the escapement locks.

FIG. 1 shows a representation of the main parts of an escapement. An escapement comprises a balance wheel 11, a pallet fork 12 and an escapement wheel 13. The balance wheel 11 comprises an impulse pin 14, which strikes against the pallet fork 12. Further, the escapement wheel 13 comprises teeth that are arranged to strike an entry pallet jewel 15 and an exit pallet jewel 16 of the pallet fork 12.

According to an embodiment of a method for authenticating a timepiece according to the invention, the acoustic vibrations of a timepiece to be authenticated are measured, for instance using a microphone, preferably a contact piezoelectric microphone. The acoustic vibrations emitted by the timepiece are measured and an electrical signal is obtained, which indicates a variation of the magnitude of the measured acoustic vibrations as a function of time. Such an electrical signal is represented in FIGS. 2 to 4.

Figure 2:
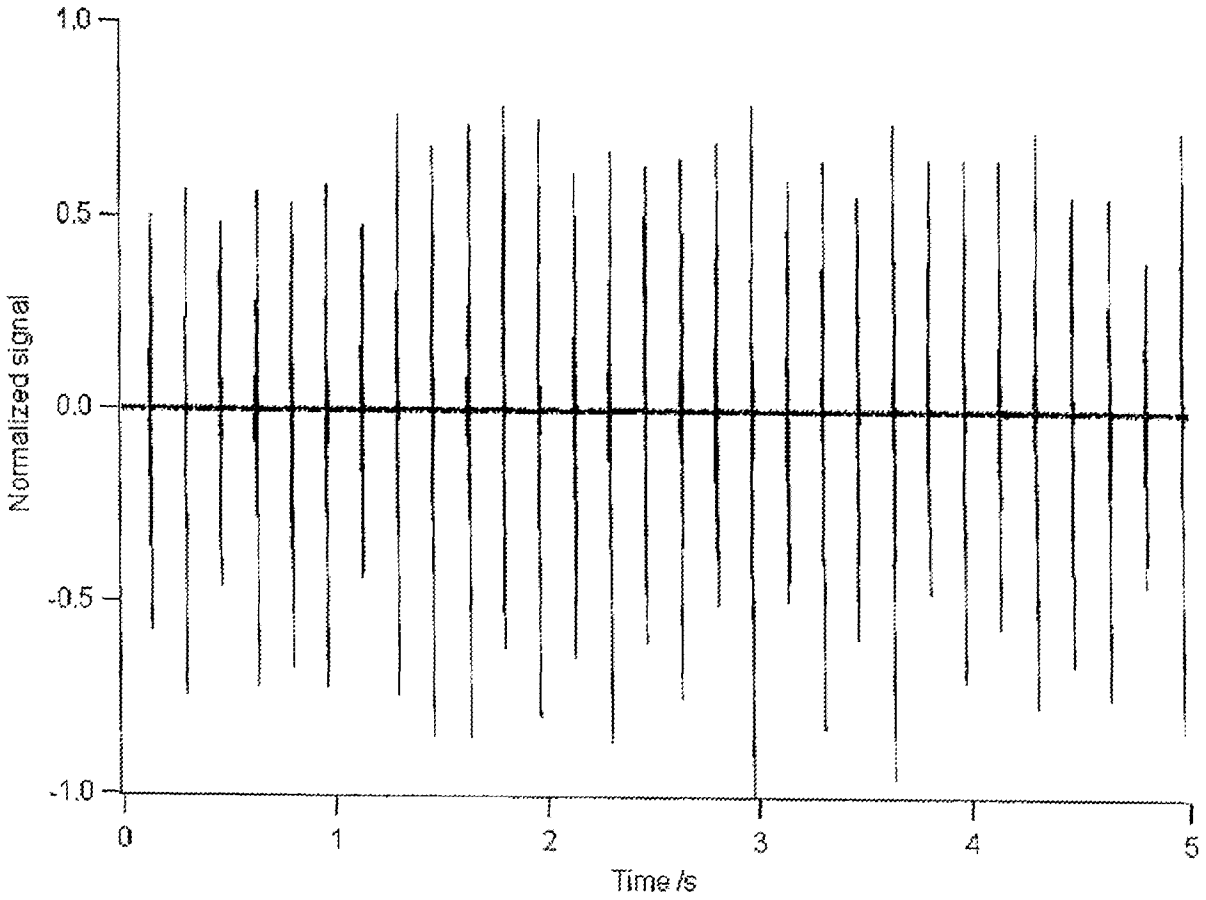
FIG. 2 is a representation of acoustic vibrations in a timepiece as a function of time.

FIG. 2 represents the acoustic vibrations emitted by a timepiece as a function of time. The represented signal has a frequency of 3 Hz (also a rate of oscillation of 3 Hz, i.e. three oscillations, (six beats) take place every single second). The signal alternates between tick events and tock events.

Figure 3:
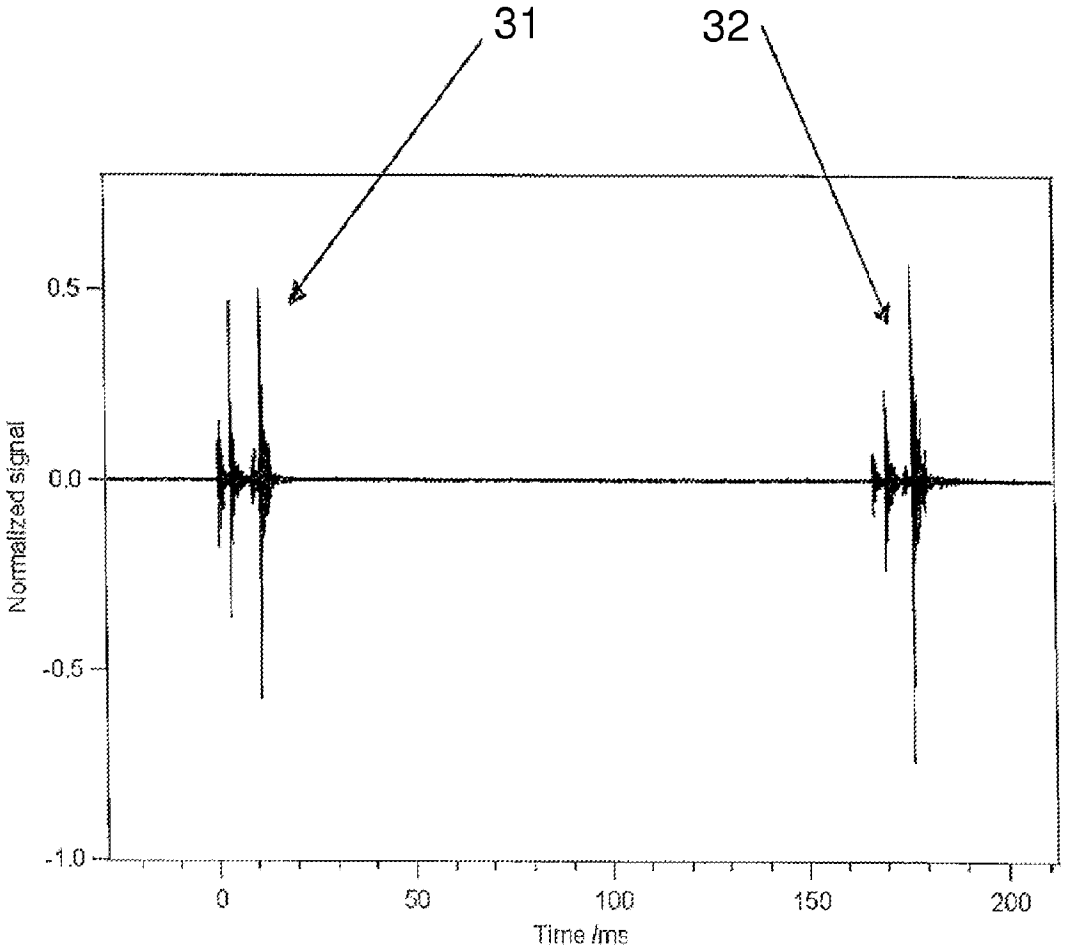
FIG. 3 is a close-up view on two events in the time sequence represented in FIG. 2.

FIG. 3 represents a closer view on the start of the sequence of tick events and tock events shown in FIG. 2. FIG. 3 shows a first event 31 and a second event 32 of the sequence of ticks and tocks of FIG. 2. The first event 31 spreads in a time range comprised between about 0 and 15 ms, while the second event 32 spreads in a time range comprised between about 165 ms and 185 ms. The events 31 and 32 are separated from each other by a so-called quiet zone, which extends between about 15 ms and 165 ms, in which the contribution of the mechanical shocks to the signal is extremely weak. As can be seen from FIG. 3, each one of the first event 31 and second event 32 is itself a sequence of several sub-events, which are illustrated in more detail in FIG. 4.

Figure 4:
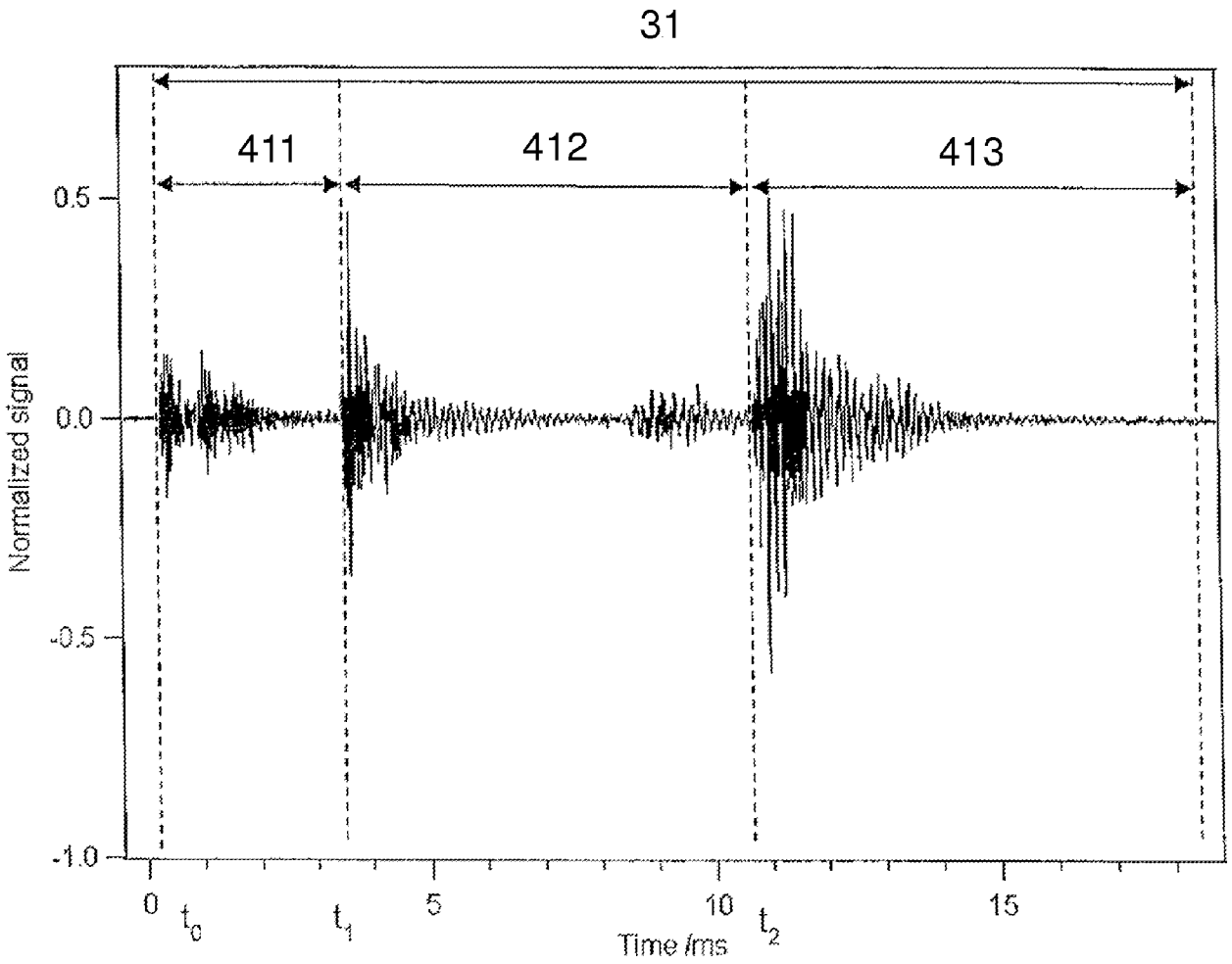
FIG. 4 is a close-up view on the first event represented in FIG. 3.

FIG. 4 shows a close-up view on the first event 31 in the representation of FIG. 3. The first event 31 comprises a first sub-event 411, a second sub-event 412 and a third sub-event 413. The first sub-event 411 takes place in a time range comprised between about 0 and 3 ms, the second sub-event 412 takes place in a time range comprised between about 3.5 ms and about 10.5 ms. The third sub-event 413 takes place in a time range comprised between about 10.5 ms and about 18 ms. The first sub-event 411, second sub-event 412 and third sub-event 413 there fore make up the first event 31 shown in FIG. 3, which corresponds to one acoustic event of the timepiece.

Figure 5:
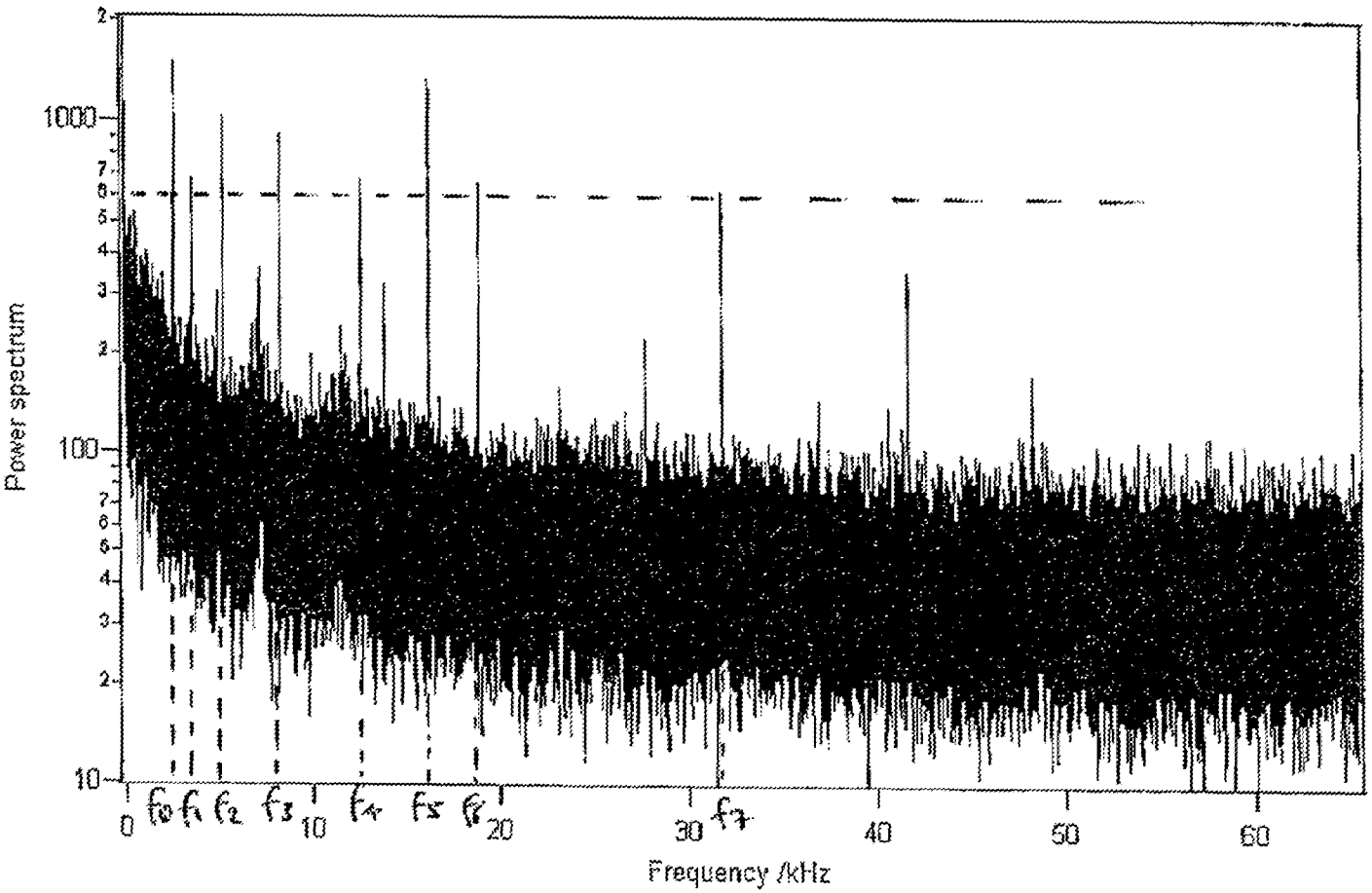
FIG. 5 illustrates an embodiment of a method for authenticating a timepiece according to embodiments of the invention.

FIG. 5 illustrates an embodiment of a method for authenticating a timepiece according to aspects of the present invention. FIG. 5 is a representation of the power spectrum of the measured acoustic vibrations emitted by a timepiece to be authenticated as a function of frequency. In the following, the various steps of the method for authenticating a timepiece according to this embodiment of the invention will be described.

First, the acoustic vibrations emitted by a timepiece to be authenticated are measured and an electrical signal is obtained, which indicates a variation of the magnitude of the measured acoustic vibrations as a function of time. The electrical signal comprises a plurality of acoustic events, as those represented in FIGS. 3 and 4.

After the acoustic vibrations emitted by the timepiece to be authenticated have been measured, the obtained electrical signal is processed so as to attenuate the plurality of acoustic events in the electrical signal. According to a preferred embodiment of the present invention, this attenuation of the plurality of events in the electrical signal can be achieved by carrying out the following steps. First, the electrical signal S is sampled at a predetermined sampling frequency, e.g., 96 kHz, to obtain a digital signal, e.g., a 16-bit signal. An envelope E of the obtained sampled signal is calculated by averaging an absolute value of the plurality of samples, e.g., the last 200 samples. Then, a ratio A of the sampled electrical signal S divided by the calculated envelope E of the sampled electrical signal S is calculated. The calculation of this ratio A=S/E allows for attenuating the loud vibrations, thereby revealing the weak vibrations during the quiet zone.

After processing the electrical signal so as to attenuate the plurality of acoustic events in the electrical signal, a transform of the processed electrical signal into a frequency domain is performed, in order to obtain a frequency-domain power spectrum indicating a variation of the power of the processed electrical signal as a function of frequency. According to a preferred embodiment of the present invention, the frequency-domain transform is a Fourier transform, preferably a Fast Fourier transform. However, other frequency-domain transforms could also be utilized.

Reverting to the exemplary values mentioned above with respect to the attenuation of the acoustic events in the electrical signal, a Fast Fourier transform of the ratio A signal is carried out on a number (e.g., a large number) of consecutive values. In the particular example represented in FIG. 5, the Fast Fourier transform of the ratio A signal, which has been sampled at 130 kHz, was performed on 655,360 consecutive values thereof. This analysis allows for obtaining a frequency-domain spectrum until 65 kHz with a resolution of 0.2 Hz. Generally, it must be understood that the values indicated herewith are only meant for exemplary purposes and are not limiting the principles of the present invention. Further, various analysis durations may be selected, which may range, e.g., from 2 seconds to 2 minutes. The person skilled in the art will immediately understand that an extremely fine frequency analysis of the ratio A signal can be performed, which will permit a spectrum having easily recognizable peaks.

After the transform of the processed electrical signal into the frequency domain has been performed to obtain a frequency-domain power spectrum, the frequency-domain power spectrum is processed so as to reveal a narrow peak or a plurality of narrow peaks in the frequency-domain power spectrum. These narrow peaks correspond to resonance frequencies of a mechanical part or a plurality of mechanical parts within the timepiece to be authenticated. These mechanical parts resonate in the quiet zone, but their signal is often difficult to detect, since it is an extremely weak signal. Embodiments of the present invention present a way of extracting the information on the resonance frequencies of these mechanical parts, wherein the obtained resonance frequency information can be used for authentication purposes.

According to an embodiment of the invention, the processing of the frequency-domain power spectrum so as to reveal at least one narrow peak in the frequency-domain power spectrum comprises filtering the frequency-domain power spectrum so as to reduce the background noise signal and keep the sharp peaks, e.g., by performing a derivative of the spectrum with respect to frequency, or by wavelet de-noising of the spectrum.

According to another embodiment, a fast and convenient method to carry out the processing step of processing the frequency-domain power spectrum so as to reveal at least one narrow peak in the frequency-domain power spectrum comprises the following steps. First, for each frequency F of the frequency-domain power spectrum, a module M(F) of a complex number obtained in performing the transform of the processed electrical signal into the frequency domain is calculated. Then, a value V(F) of M(F) multiplied by the double derivative in frequency is calculated. This multiplication allows for revealing the narrow peaks in the frequency-domain power spectrum, and thus, reveals the resonance frequencies of mechanical parts resonating in the quiet zone. The module M(F) of the complex number is multiplied by an absolute value of a difference between the module M(F) of the complex number and a module M(F−1) of a complex number for an immediately preceding frequency (F−1). The obtained number is further multiplied by an absolute value of a difference between the module M(F) of the complex number for frequency F and the module M(F+1) of the complex number for an immediately following frequency (F+1). This calculation is summarized by the following equation (1):

$$V(F)=M(F)\times\text{abs}(M(F)-M(F-1))\times\text{abs}(M(F)-M(F+1)) \quad (1)$$

where abs(X) represents the absolute value of X.

According to an embodiment of the present invention, the resonance frequency corresponding to the identified narrow peak in the frequency-domain power spectrum (or a plurality of such resonance frequencies) is extracted. The frequency-power spectrum of the measured acoustic vibrations of the timepiece to be authenticated reveals several peaks in the power spectrum representation at several frequencies. In the particular example represented in FIG. 5, eight peaks can be identified in the power spectrum, the power spectrum value of which is larger than 600 on the logarithmic scale of FIG. 5. These peaks in the power spectrum can be identified at frequencies $f_0$, to $f_7$, which are comprised in the range between 0 and about 32 kHz. It must be noted that these values are given for illustrative purposes only and are not limiting. In particular, even though the particular example of a threshold set at 600 for identifying peaks in the power spectrum has been given, the person skilled in the art will immediately understand that another threshold may be set, depending on the amount of frequency peaks desired as frequency information. For instance, the threshold could be set at 1000, so that only a few peaks can be identified.

The respective frequencies $f_0$, to $f_7$ in the example of FIG. 5 corresponding to peaks in the frequency-domain power spectrum of the measured acoustic vibrations of the timepiece to be authenticated can be extracted from the frequency-domain power spectrum Then, the extracted resonance frequency or frequencies of the identified peaks in the frequency-domain power spectrum is/are compared with a reference resonance frequency or frequencies. The reference resonance frequencies have been stored previously and correspond to the values obtained when performing the above method steps on a particular timepiece model. By storing the resonance frequency values for a timepiece model, reference resonance frequency information is stored, which can be used for comparison with a timepiece to be authenticated. The comparison results give information on an authenticity of the timepiece to be authenticated.

It has been observed by the inventors of the present invention that the reliability and degree of precision of the invention are such that it is possible to even identify differences between the timepieces of an identical model. Indeed, timepieces that are manufactured by hand are unique, so that two timepieces of an identical model differ from each other with differences that at first look are merely imperceptible. When applying the principles underlined in the present invention to different timepieces from the same series and the same company, it can be seen that the corresponding acoustic measurements are different and the extracted relevant respective pieces of frequency information, which characterize the fingerprint of the respective timepiece, are different. Hence, an identifier can be defined for a timepiece without having to open the timepiece.

According to an embodiment of the invention, the processing steps for revealing the narrow peaks in the frequency-domain power spectrum are repeated and, for each frequency F of the frequency-domain power spectrum, an average of the results V(F) of the repeated calculating and multiplying steps is calculated. This average value is then represented on a graph. Such a graph is shown in FIG. 5, wherein a plurality of narrow peaks can be identified. By performing the method steps described with respect to the embodiments of the present invention, the contribution of the acoustic vibrations emitted by the timepiece to be authenticated in the quiet zone between acoustic events is, so to say, highlighted or "amplified." On the other hand, the contribution of the loud acoustic events is attenuated by processing the electrical signal according to the embodiments of the present invention. Hence, by performing the steps according to the embodiments of the present invention, a frequency-domain power spectrum is obtained in which clearly recognizable narrow peaks can be extracted which correspond to the acoustic vibrations of the mechanical parts within the timepiece to be authenticated. These acoustic vibrations are comparatively weak, when compared with the loud acoustic events taking place during the events or sub-events, but are comparatively long-lived, in comparison with these events or sub-events.

Figure 6:
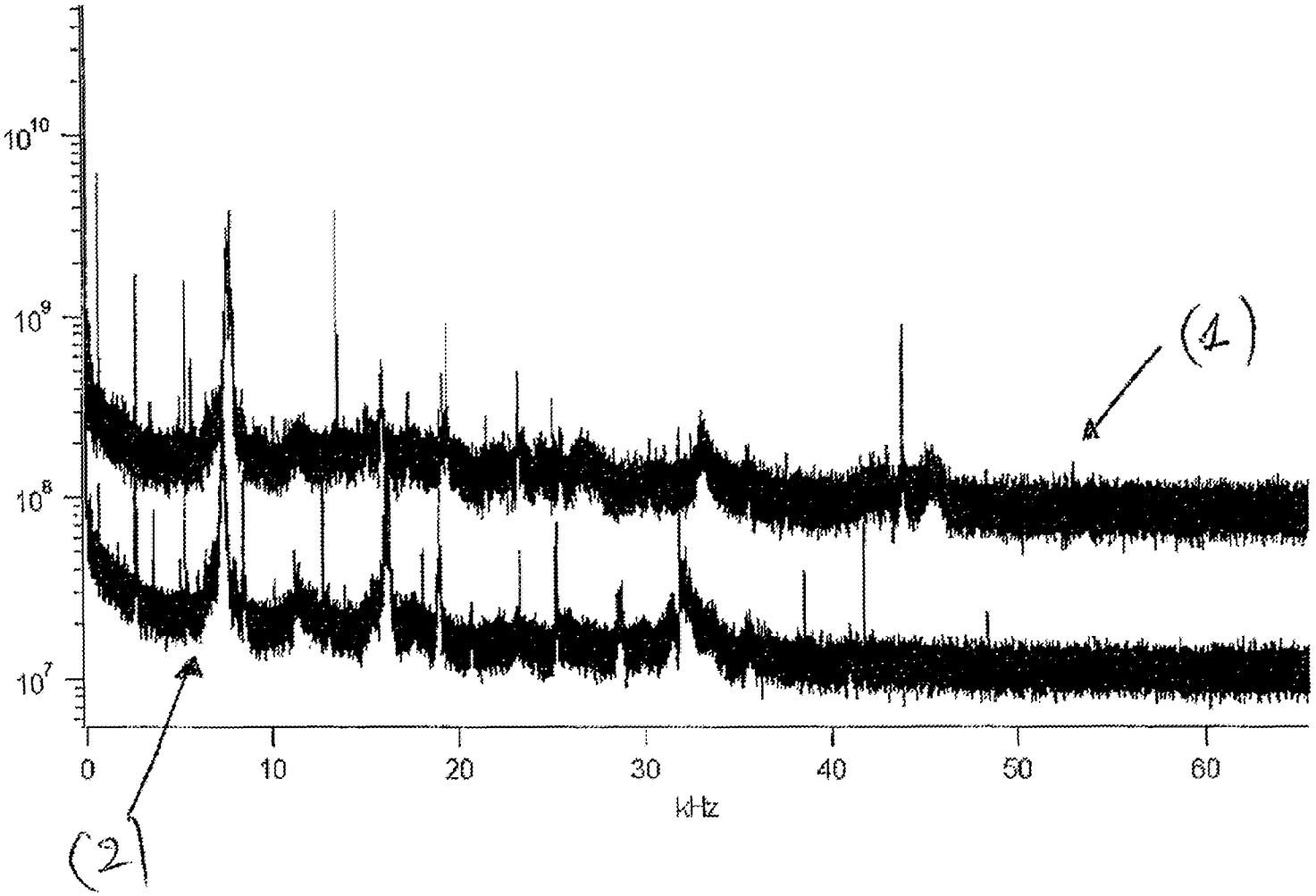
FIG. 6 shows the respective frequency-domain power spectra obtained for two timepieces (1) and (2)
Figure 7:
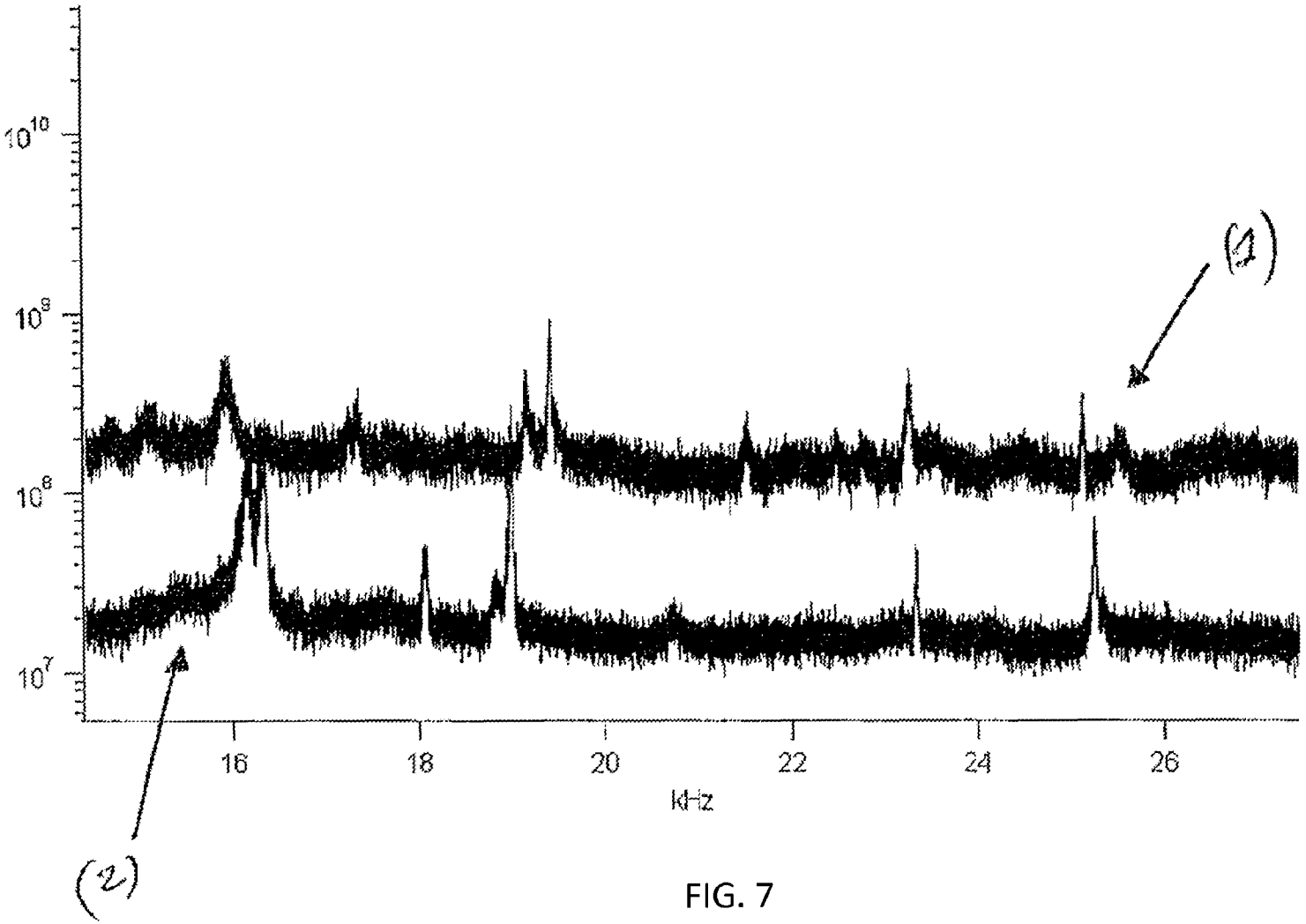
FIG. 7 shows a close-up view on a part of the respective frequency-domain power spectra obtained for the two timepieces (1) and (2) represented in FIG. 6.

FIGS. 6 and 7 illustrate the fact that clearly recognizable narrow peaks can be extracted, which allow for uniquely identifying different timepieces. FIG. 6 shows the respective frequency-domain power spectra obtained for two timepieces (1) and (2). FIG. 7 shows a close-up view on a part of the respective frequency-domain power spectra obtained for the two timepieces (1) and (2) represented in FIG. 6. It is apparent that the peaks identified for the timepiece (1) differ from those identified for the timepiece (2), thereby allowing for differentiating them from each other.

According to a variant of an embodiment of a method for authenticating a timepiece according to the present invention, the processing of the electrical signal for attenuating the plurality of events in the electrical signal obtained by measuring acoustic vibrations of the timepiece to be authenticated may be replaced by another processing step. Indeed, another possibility to attenuate the loud acoustic events is to divide the electrical signal by its average signal amplitude, where the average amplitude is found by taking the absolute value of the signal and filtering it with a low-pass filter. Another possibility would be to multiply the electrical signal by zero, wherever its average signal amplitude is larger than a given threshold. Finally, still another possibility would be to multiply the electrical signal by zero in a given time interval after the beginning of the acoustic event.

According to another variant of an embodiment of a method for authenticating a timepiece according to the present invention, a time-frequency transform of the acoustic vibrations emitted by the timepiece to be authenticated into a time-frequency domain can be used instead of a frequency-domain transform as described above with respect to FIG. 5. Unlike a transform into a frequency domain, which only gives information on the frequencies that are present in the transformed signal, a time-frequency representation gives information on which frequencies are present at which time.

According to this variant, the time-frequency transform to be used may be one among the several time-frequency transforms available and known to the person skilled in the art. In particular, only to cite a few possible transforms, the transform into a time-frequency representation may be one of the windowed Fourier transform and a wavelet transform.

The wavelet transform is described, for example, in C. Torrence and G. P. Compo, *Bulletin of the American Meteorological Society,* 79, 1998. The continuous wavelet transform takes a time-domain signal s(t), the electrical signal of the measured acoustic vibrations emitted by the timepiece to be authenticated, the electrical signal indicating a variation of the magnitude of the measured acoustic vibrations as a function of time, and transforms this time-domain signal into a time-frequency representation W(f, t), which is defined by the following equation (2):

$$W(f,t)=\sqrt{\frac{2\pi f}{c}}\int_{-\infty}^{\infty}s(t')\psi^{*}\left(\frac{2\pi f(t'-t)}{c}\right)dt' \tag{2}$$

where:

- ψ is the wavelet function (there are several types to choose from); and
- c is a constant which depends on the chosen wavelet function.

By using the time-frequency information, which is obtained from a time-frequency representation of the electrical signal obtained by measuring acoustic vibrations emitted by the timepiece to be authenticated, information on an authenticity of the timepiece can be derived. In order to do so, the time-frequency information is extracted from the time-frequency representation and compared with reference time-frequency information, which has been previously stored for the timepiece model. By comparing the time-frequency information extracted for the timepiece to be authenticated with the reference time-information for the timepiece model, it can be derived whether the timepiece is authentic or not.

According to another embodiment of the present invention, a timepiece may be amended by introducing a resonator having predetermined resonance frequency characteristics into the timepiece. By choosing the material, the thickness and the width of the resonator and selecting a particular arrangement within the timepiece, the resonance frequency characteristics of the resonator, such as the frequency, resonance width and quality factor, may be precisely determined. By introducing this resonator with predetermined resonance frequency characteristics into a timepiece, the authentication of the timepiece can be tremendously improved, since the method steps described with respect to the embodiments of the present invention can be applied to a timepiece to be authenticated and the authentication comprises searching for the predetermined known resonance frequencies within the frequency-domain power spectrum. Since the principles mentioned above allow for a frequency-domain power spectrum having easily recognizable narrow peaks, an authentication of a timepiece comprising a resonator having predetermined resonance frequency characteristics consists in extracting the resonance frequency or frequencies of the narrow peaks within the frequency-domain power spectrum and comparing these extracted resonance frequencies with the predetermined known resonance frequencies of the resonator. Hence, the resonator allows for introducing a kind of signature into a timepiece, which can then be used for authenticating a timepiece. However, even if one resonator is determined and created, it still remains that the production of the timepiece is subject to manufacturing tolerances, so that, even if a frequency is known, it remains that for two resonators, which seem to be the same, there will most likely be a small difference which could be determined in an efficient manner using the method according to the present invention. However, as already outlined above, it has been observed by the inventors of the present invention that the reliability and degree of precision of the invention are such that it is possible to identify such small differences. This, therefore, enhances the strength of the protection for the timepieces such as luxury watches, where reproducing exactly a specific watch will be merely impossible.

In certain embodiments of the invention, the one or more components whose resonant frequencies are detected may be mechanical components (e.g., the pallet fork, the escapement wheel, and/or the balance wheel, amongst other contemplated mechanical components) and/or aesthetic components, e.g., a logo or emblem, a numeral, and/or stationary elements, amongst other contemplated aesthetic components.

Most components of a timepiece have a resonant frequency that does not change over time (i.e., remains stable). For example, as long as a component of the watch (e.g., a crown emblem or logo) is not touched or manipulated, the resonant frequency of that component will not change. Of course, with maintenance of the time piece, the resonant frequency of one or more components may be affected. As such, when timepiece maintenance is performed, the timepiece should be recertified (e.g., the sound of the timepiece should be recaptured and the one or more resonant frequencies should be identified and stored). In embodiments, once the timepiece is recertified, the results of the one or more the above-described measurements may also be linked with the timepiece ID (e.g., the timepiece serial number), for example, in a database.

While most components of a timepiece have a resonant frequency that does not change over time, the embodiments of the invention contemplate that some components' resonant frequency may change (e.g., slightly) over time. By way of a non-limiting example, the escape wheel may change in mass with wear as the timepiece ages. Thus, in accordance with embodiments of the invention, a threshold for determining a positive authentication of a timepiece may be configured (e.g., lowered) in dependence upon an age of the timepiece. That is, in embodiments, an older timepiece may be subjected to a lower threshold for a positive authentication via comparison with stored resonant frequencies (or stored identifiers based upon the resonant frequencies). In embodiments, the timepiece may be recertified on a regular basis (e.g., yearly) to account for the evolution (e.g., any property changes) of the timepiece over time.

In embodiments of the invention, the one or more components whose resonant frequencies are detected may be two or more elements that act as a single resonator.

In an exemplary and non-limiting embodiment, a resonant frequency may be 48.23 kHz. This may be a resonant frequency for a particular movement or a family of movements. In accordance with aspects of embodiments of the invention, if the resonant frequency is not detected, then the timepiece (or component) can be identified as counterfeit.

System Environment

As will be appreciated by one skilled in the art, the present invention may be embodied as a timepiece, a system, a method or a computer program product. Accordingly, the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present invention may take the form of a computer program product embodied in any tangible medium of expression having computer-usable program code embodied in the medium.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following:

an electrical connection having one or more wires,
a portable computer diskette,
a hard disk,
a random access memory (RAM),
a read-only memory (ROM),
an erasable programmable read-only memory (EPROM or Flash memory),
an optical fiber,
a portable compact disc read-only memory (CDROM),
an optical storage device,
a transmission media such as those supporting the Internet or an intranet,
a magnetic storage device
a usb key,
a certificate,
a perforated card, and/or
a mobile phone.

In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer program code for carrying out operations of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network. This may include, for example, a local area network (LAN) or a wide area network (WAN), or the connection may be made to an external computer (for example, through the Internet using an Internet Service Provider). Additionally, in embodiments, the present invention may be embodied in a field programmable gate array (FPGA).

Figure 8:
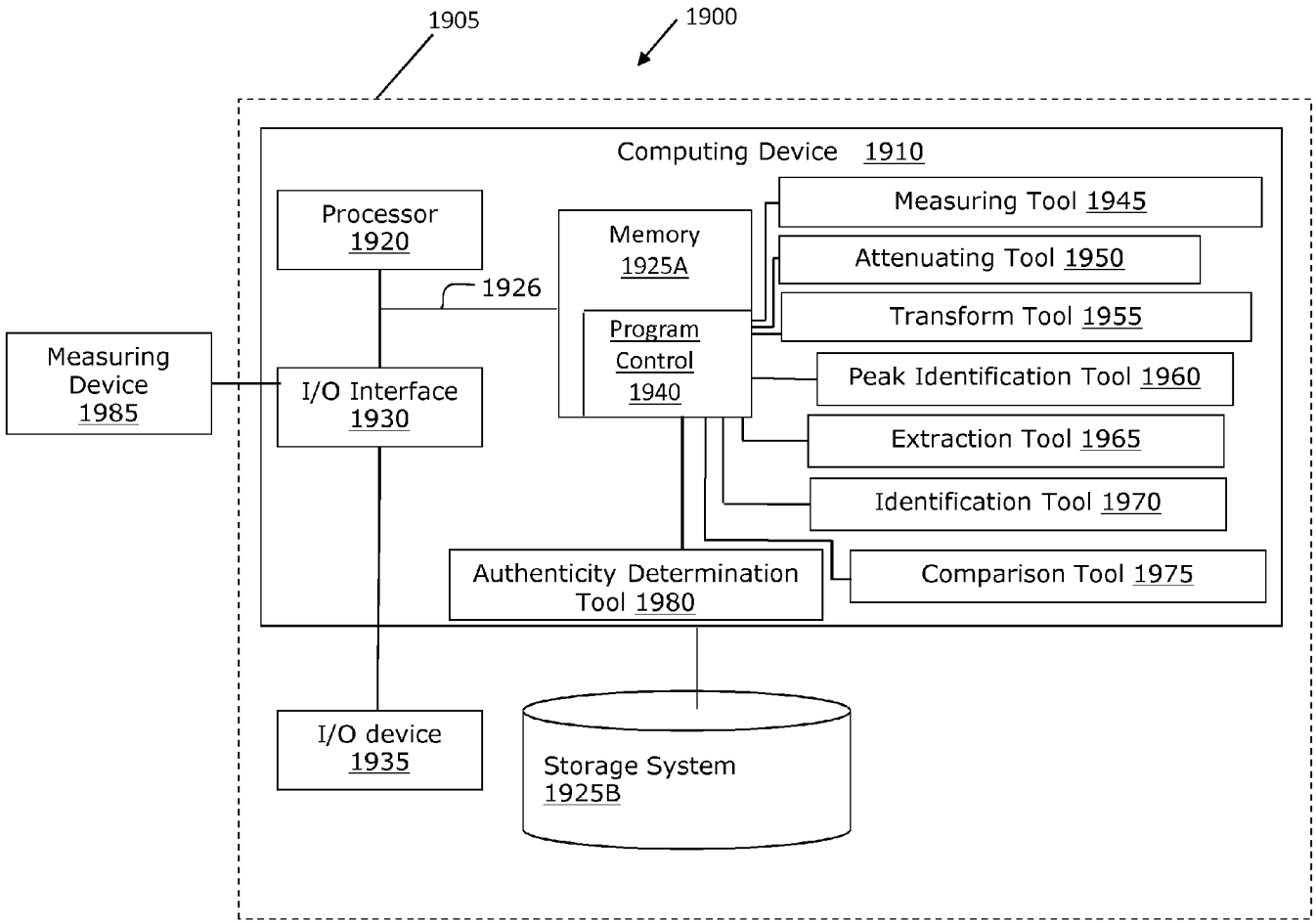
FIG. 8 shows an illustrative environment for managing the processes in accordance with the invention.

FIG. 8 shows an illustrative environment 1900 for managing the processes in accordance with the invention. To this extent, the environment 1900 includes a server or other computing system 1905 that can perform the processes described herein. In particular, the server 1905 includes a computing device 1910. The computing device 1910 can be resident on a network infrastructure or computing device of a third party service provider (any of which is generally represented in FIG. 8).

In embodiments, the computing device 1910 includes a measuring tool 1945, an attenuating tool 1950, a transform tool 1955, a peak identification tool 1960, an extraction tool 1965, an identification tool 1970, a comparison tool 1975, and an authenticity determination tool 1980, which are operable to measure one or more detected sounds, attenuate portions of the one or more detected sounds, transform the signal, identify peaks in a signal, extract at least one resonance frequency, compare the at least one resonance frequency, and determine an authenticity, e.g., the processes described herein. The measuring tool 1945, the attenuating tool 1950, the transform tool 1955, the peak identification tool 1960, the extraction tool 1965, the identification tool 1970, the comparison tool 1975, and the authenticity determination tool 1980 can be implemented as one or more program code in the program control 1940 stored in memory 1925A as separate or combined modules.

The computing device 1910 also includes a processor 1920, memory 1925A, an I/O interface 1930, and a bus 1926. The memory 1925A can include local memory employed during actual execution of program code, bulk storage, and cache memories which provide temporary storage of at least some program code in order to reduce the number of times code must be retrieved from bulk storage during execution. In addition, the computing device includes random access memory (RAM), a read-only memory (ROM), and an operating system (O/S).

The computing device 1910 is in communication with the external I/O device/resource 1935 and the storage system 1925B. For example, the I/O device 1935 can comprise any device that enables an individual to interact with the computing device 1910 or any device that enables the computing device 1910 to communicate with one or more other computing devices using any type of communications link. The external I/O device/resource 1935 may be for example, a handheld device, PDA, handset, keyboard, smartphone, etc. Additionally, in accordance with aspects of the invention, the environment 1900 includes a measuring device 1985 for measuring sound vibrations (e.g., sonic emissions) from one or more timepieces.

In general, the processor 1920 executes computer program code (e.g., program control 1940), which can be stored in the memory 1925A and/or storage system 1925B. Moreover, in accordance with aspects of the invention, the program control 1940 having program code controls the measuring tool 1945, the attenuating tool 1950, the transform tool 1955, the peak identification tool 1960, the extraction tool 1965, the identification tool 1970, the comparison tool 1975, and the authenticity determination tool 1980. While executing the computer program code, the processor 1920 can read and/or write data to/from memory 1925A, storage system 1925B, and/or I/O interface 1930. The program code executes the processes of the invention. The bus 1926 provides a communications link between each of the components in the computing device 1910.

The computing device 1910 can comprise any general purpose computing article of manufacture capable of executing computer program code installed thereon (e.g., a personal computer, server, etc.). However, it is understood that the computing device 1910 is only representative of various possible equivalent-computing devices that may perform the processes described herein. To this extent, in embodiments, the functionality provided by the computing device 1910 can be implemented by a computing article of manufacture that includes any combination of general and/or specific purpose hardware and/or computer program code. In each embodiment, the program code and hardware can be created using standard programming and engineering techniques, respectively.

Similarly, the computing infrastructure 1905 is only illustrative of various types of computer infrastructures for implementing the invention. For example, in embodiments, the server 1905 comprises two or more computing devices (e.g., a server cluster) that communicate over any type of communications link, such as a network, a shared memory, or the like, to perform the process described herein. Further, while performing the processes described herein, one or more computing devices on the server 1905 can communicate with one or more other computing devices external to the server 1905 using any type of communications link. The communications link can comprise any combination of wired and/or wireless links; any combination of one or more types of networks (e.g., the Internet, a wide area network, a local area network, a virtual private network, etc.); and/or utilize any combination of transmission techniques and protocols.

Flow Diagrams

Figure 9:
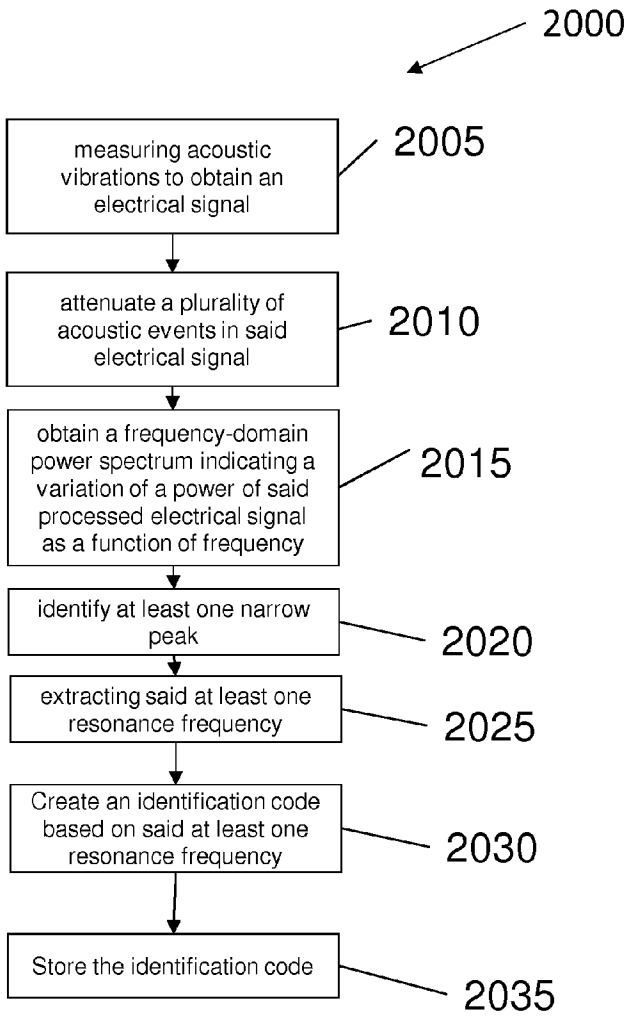
FIGS. 9 and 10 show exemplary flows for performing aspects of the present invention.
Figure 10:
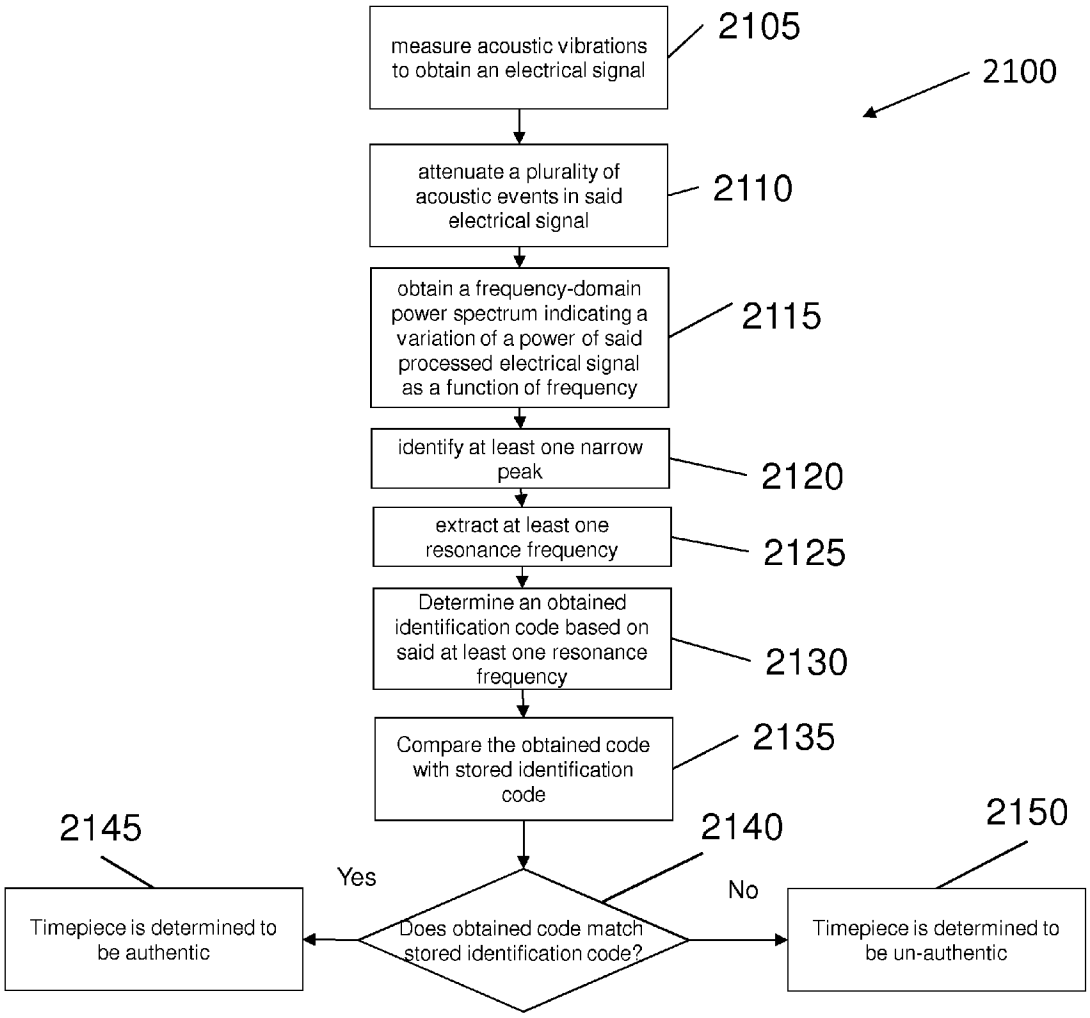

FIGS. 9 and 10 show exemplary flows for performing aspects of the present invention. The steps of FIGS. 9 and 10 may be implemented in the environment of FIG. 8, for example. The flow diagrams may equally represent high-level block diagrams of embodiments of the invention. The flowcharts and/or block diagrams in FIGS. 9 and 10 illustrate the architecture, functionality, and operation of possible implementations of systems, methods and computer program products according to various embodiments of the present invention. In this regard, each block in the flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Each block of each flowchart, and combinations of the flowchart illustrations can be implemented by special purpose hardware-based systems that perform the specified functions or acts, or combinations of special purpose hardware and computer instructions and/or software, as described above. Moreover, the steps of the flow diagrams may be implemented and executed from either a server, in a client server relationship, or they may run on a user workstation with operative information conveyed to the user workstation. In an embodiment, the software elements include firmware, resident software, microcode, etc.

Furthermore, the invention can take the form of a computer program product accessible from a computer-usable or computer-readable medium providing program code for use by or in connection with a computer or any instruction execution system. The software and/or computer program product can be implemented in the environment of FIG. 8. For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium. Examples of a computer-readable storage medium include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disc—read/write (CD-R/W) and DVD.

FIG. 9 illustrates an exemplary flow 2000 for creating and storing an identification code for a timepiece. At step 2005, the measuring tool measures acoustic vibrations to obtain an electrical signal. As shown in FIG. 9, at step 2010, the attenuating tool attenuates a plurality of acoustic events in said electrical signal. At step 2015, the transform tool obtains a frequency-domain power spectrum indicating a variation of a power of said processed electrical signal as a function of frequency. At step 2020, the peak identification tool identifies at least one narrow peak. At step 2025, the extraction tool extracts at least one resonance frequency. At step 2030, the identification tool creates an identification code based on said at least one resonance frequency. At step 2035, the identification tool stores the identification code in a storage system, e.g., a database.

FIG. 10 illustrates an exemplary flow 2100 for authentication and/or identification of a time piece. As shown in FIG. 10, at step 2105, the measuring tool measures acoustic vibrations to obtain an electrical signal. At step 2110, the attenuating tool attenuates a plurality of acoustic events in said electrical signal. At step 2115, the transform tool obtains a frequency-domain power spectrum indicating a variation of a power of said processed electrical signal as a function of frequency. At step 2120, the peak identification tool identifies at least one narrow peak. At step 2125, the extraction tool extracts at least one resonance frequency. At step 2130, the identification tool creates an obtained identification code based on said at least one resonance frequency. At step 2135, the comparison tool compares the obtained code with stored identification codes. At step 2140, the authentication determination tool determines whether the obtained code matches a stored identification code. If, at step 2140, the authentication determination tool determines that the obtained code matches a stored identification code, at step 2145, the timepiece is determined to be authentic. If, at step 2140, the authentication determination tool determines that the obtained code match does not match a stored identification code, at step 2150, the timepiece is determined to be un-authentic.

While the invention has been described with reference to specific embodiments, those skilled in the art will understand that various changes may be made and equivalents may be substituted for elements thereof without departing from the true spirit and scope of the invention. In addition, modifications may be made without departing from the essential teachings of the invention.

What is claimed is:

1. A method for authenticating a timepiece comprising:

measuring acoustic vibrations emitted by said timepiece to obtain an electrical signal, said electrical signal indicating a variation of a magnitude of said measured acoustic vibrations as a function of time, wherein said electrical signal comprises a plurality of acoustic events associated with mechanical shocks taking place in said timepiece, said acoustic events being separated from each other by respective quiet zones;

processing said electrical signal so as to attenuate said plurality of acoustic events in said electrical signal;

performing a transform of said processed electrical signal into a frequency domain to obtain a frequency-domain power spectrum indicating a variation of a power of said processed electrical signal as a function of frequency using a processor of a computing device;

processing said frequency-domain power spectrum so as to identify at least one narrow peak in said frequency-domain power spectrum corresponding to at least one resonance frequency of a part of said timepiece resonating in a quiet zone;

extracting said at least one resonance frequency corresponding to said at least one narrow peak;

comparing said extracted at least one resonance frequency with at least one reference resonance frequency; and determining an authenticity of said timepiece based on the comparing.

2. The method according to claim 1, wherein said transform of said processed electrical signal into a frequency domain is a Fourier transform.

3. The method according to claim 2, wherein the Fourier transform is a Fast Fourier transform.

4. The method according to claim 1, wherein said processing said electrical signal so as to attenuate said plurality of events in said electrical signal comprises:

sampling said electrical signal (S);

calculating an envelope (E) of said sampled electrical signal (S) by averaging an absolute value of a plurality of samples; and calculating a ratio of said sampled electrical signal (S) divided by said calculated envelope (E) of said sampled electrical signal (S).

5. The method according to one of claim 1, wherein said processing said frequency-domain power spectrum so as to reveal at least one narrow peak in said frequency-domain power spectrum comprises filtering said frequency-domain power spectrum so as to reduce a background part and retain sharp peaks within said frequency-domain power spectrum.

6. The method according to claim 1, wherein said processing said frequency-domain power spectrum so as to reveal at least one narrow peak in said frequency-domain power spectrum comprises:

calculating, for each frequency (F) of said frequency-domain power spectrum, a module (M(F)) of a complex number obtained in performing said transform of said processed electrical signal into a frequency domain; and multiplying said module (M(F)) of said complex number by an absolute value of a difference between said module (M(F)) of said complex number and a module (M(F−1)) of a complex number for an immediately preceding frequency and by an absolute value of a difference between said module (M(F)) of said complex number and a module (M(F+1)) of a complex number for an immediately following frequency.

7. The method according to claim 6, further comprising:

repeating said calculating and multiplying a predetermined number of times; and determining, for each frequency (F) of said frequency-domain power spectrum, an average of results (V(F)) of said repeated calculating and multiplying.

8. The method according to claim 1, further comprising extracting a width of said revealed at least one narrow peak.

9. The method according to claim 1, further comprising extracting a relative amplitude of said revealed at least one narrow peak.

10. The method according to claim 1, further comprising introducing a resonator into said timepiece, said resonator having predetermined resonance frequency characteristics, wherein said comparing comprises comparing said extracted at least one resonance frequency with said predetermined resonance frequency characteristics to derive information on an authenticity of said timepiece.

11. The method according to claim 10, wherein at least one of a material, thickness and width of said resonator is selected so as to obtain said predetermined resonance frequency characteristics.

12. The method according to claim 10, further comprising encoding said predetermined resonance frequency characteristics to create a unique identifier for said timepiece having said resonator introduced therein.

13. The method according to claim 1, wherein the part is a mechanical part.

14. The method according to claim 10, wherein the information on an authenticity of said timepiece comprises one of an indication of authenticity and an indication of a counterfeit.

15. The method according to claim 1, further comprising recertifying the timepiece when timepiece maintenance is performed.

16. The method according to claim 1, wherein a threshold for determining a positive authentication of a timepiece is configured in dependence upon an age of the timepiece.

17. The method according to claim 1, wherein the one or more components whose resonance frequencies are detected may be two or more components acting as a single resonator.

18. A timepiece comprising a resonator having predetermined resonance frequency characteristics being selected so as to be recognizable based on at least one narrow peak in a frequency-domain power spectrum upon carrying out the method for authenticating a timepiece according to claim 1.

19. A timepiece according to claim 18, wherein said timepiece is a watch.

20. A non-transitory computer readable medium for storing instructions, which, upon being executed by a processor of a computer device, cause the processor to execute a method comprising:

measuring acoustic vibrations emitted by a timepiece to obtain an electrical signal, said electrical signal indicating a variation of a magnitude of said measured acoustic vibrations as a function of time, wherein said electrical signal comprises a plurality of acoustic events associated with mechanical shocks taking place in said timepiece, said acoustic events being separated from each other by respective quiet zones;

processing said electrical signal so as to attenuate said plurality of acoustic events in said electrical signal;

performing a transform of said processed electrical signal into a frequency domain to obtain a frequency-domain power spectrum indicating a variation of a power of said processed electrical signal as a function of frequency;

processing said frequency-domain power spectrum so as to reveal at least one narrow peak in said frequency-domain power spectrum corresponding to at least one resonance frequency of a part of said timepiece resonating in a quiet zone;

extracting said at least one resonance frequency corresponding to said at least one narrow peak;

comparing said extracted at least one resonance frequency with at least one reference resonance frequency; and determining information regarding an authenticity of said timepiece based on the comparing.

21. The computer readable medium of claim 20, wherein the part is a mechanical part.

22. The computer readable medium of claim 20, wherein the information regarding authenticity of said timepiece comprises one of an indication of authenticity and an indication of a counterfeit.

23. A system for authenticating a timepiece comprising:

a measuring tool configured to measure acoustic vibrations emitted by said timepiece to obtain an electrical signal, said electrical signal indicating a variation of a magnitude of said measured acoustic vibrations as a function of time, wherein said electrical signal comprises a plurality of acoustic events associated with mechanical shocks taking place in said timepiece, said acoustic events being separated from each other by respective quiet zones;

an attenuating tool configured to process said electrical signal to attenuate said plurality of acoustic events in said electrical signal;

a transform tool configured to perform a transform of said processed electrical signal into a frequency domain to obtain a frequency-domain power spectrum indicating a variation of a power of said processed electrical signal as a function of frequency using a processor of a computing device;

a peak identification tool configured to process said frequency-domain power spectrum so as to reveal at least one narrow peak in said frequency-domain power spectrum corresponding to at least one resonance frequency of a part of said timepiece resonating in a quiet zone;

an extraction tool configured to extract said at least one resonance frequency corresponding to said at least one narrow peak; and an identification tool configured to create an identification code based on said at least one resonance frequency.

24. The system of claim 23, further comprising:

a comparison tool configured to compare said extracted at least one resonance frequency with at least one reference resonance frequency; and an authenticity determination tool configured to determine an authenticity of said timepiece based on a result of the comparison tool.

25. The system of claim 23, wherein the part is a mechanical part.

26. The system of claim 23, wherein the part is an aesthetic part.

27. A method for generating an identifier for a timepiece, the method comprising:

measuring acoustic vibrations emitted by said timepiece to obtain an electrical signal, said electrical signal indicating a variation of a magnitude of said measured acoustic vibrations as a function of time, wherein said electrical signal comprises a plurality of acoustic events associated with mechanical shocks taking place in said timepiece, said acoustic events being separated from each other by respective quiet zones;

processing said electrical signal so as to attenuate said plurality of acoustic events in said electrical signal;

performing a transform of said processed electrical signal into a frequency domain to obtain a frequency-domain power spectrum indicating a variation of a power of said processed electrical signal as a function of frequency using a processor of a computing device;

processing said frequency-domain power spectrum so as to identify at least one narrow peak in said frequency-domain power spectrum corresponding to at least one resonance frequency of a part of said timepiece resonating in a quiet zone;

extracting said at least one resonance frequency corresponding to said at least one narrow peak; and creating an identification code based on the at least one resonance frequency.

28. The method of claim 27, further comprising storing the identification code in a storage system.

29. A method for generating an identifier for a timepiece, the method comprising:

measuring acoustic vibrations emitted by said timepiece to obtain an electrical signal;

identifying at least one narrow peak in a frequency-domain power spectrum corresponding to at least one resonance frequency of a part of said timepiece resonating using a processor of a computing device;

extracting said at least one resonance frequency corresponding to said at least one narrow peak; and creating an identification code based on the at least one resonance frequency.

30. A method for authenticating an item, the method comprising:

measuring acoustic vibrations emitted by the item to obtain an electrical signal;

identifying at least one resonance frequency using the electrical signal; and creating an identification code based on the at least one resonance frequency using a processor of a computing device.

31. The method of claim 30, further comprising:

comparing the at least one resonance frequency with at least one reference resonance frequency; and determining an authenticity of the item based on the comparing.

32. The method of claim 30, further comprising:

comparing the identification code with at least one reference identification code; and determining an authenticity of the item based on the comparing.

33. The method of claim 30, wherein the item comprises a timepiece.

34. The method of claim 33, wherein the timepiece comprises a watch.

35. The method of claim 30, wherein the electrical signal indicates a variation of a magnitude of the measured acoustic vibrations as a function of time, wherein said electrical signal comprises a plurality of acoustic events associated with mechanical shocks taking place in said timepiece, said acoustic events being separated from each other by respective quiet zones.

36. The method of claim 35, further comprising processing said electrical signal to attenuate said plurality of acoustic events in said electrical signal.

37. The method of claim 36, wherein said processing said electrical signal so as to attenuate said plurality of events in said electrical signal comprises:

sampling said electrical signal (S); calculating an envelope (E) of said sampled electrical signal (S) by averaging an absolute value of a plurality of samples; and calculating a ratio of said sampled electrical signal (S) divided by said calculated envelope (E) of said sampled electrical signal (S).

38. The method of claim 36, further comprising performing a transform of said processed electrical signal into a frequency domain to obtain a frequency-domain power spectrum indicating a variation of a power of said processed electrical signal as a function of frequency.

39. The method of claim 38, wherein said transform of said processed electrical signal into a frequency domain is a Fourier transform.

40. The method of claim 38, wherein the identifying at least one resonance frequency using the electrical signal comprises processing the frequency-domain power spectrum to identify at least one narrow peak in said frequency-domain power spectrum corresponding to the at least one resonance frequency of a part of said timepiece resonating in a quiet zone.

41. The method of claim 40, wherein said processing said frequency-domain power spectrum so as to reveal at least one narrow peak in said frequency-domain power spectrum comprises filtering said frequency-domain power spectrum so as to reduce a background part and retain sharp peaks within said frequency-domain power spectrum.

42. The method according to claim 40, wherein said processing said frequency-domain power spectrum so as to reveal at least one narrow peak in said frequency-domain power spectrum comprises:

calculating, for each frequency (F) of said frequency-domain power spectrum, a module (M(F)) of a complex number obtained in performing said transform of said processed electrical signal into a frequency domain; and multiplying said module (M(F)) of said complex number by an absolute value of a difference between said module (M(F)) of said complex number and a module (M(F−1)) of a complex number for an immediately preceding frequency and by an absolute value of a difference between said module (M(F)) of said complex number and a module (M(F+1)) of a complex number for an immediately following frequency.

43. The method of claim 40, further comprising extracting the at least one resonance frequency corresponding to said at least one narrow peak.

* * * * *